US010486124B2

(12) United States Patent
Stewart et al.

(10) Patent No.: US 10,486,124 B2
(45) Date of Patent: Nov. 26, 2019

(54) SYSTEMS FOR MIXING A LIQUID AND RELATED METHODS

(71) Applicant: Cabot Microelectronics Corporation, Aurora, IL (US)

(72) Inventors: Justin Stewart, Aurora, IL (US); Marc Maxim, Batavia, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 154 days.

(21) Appl. No.: 15/684,470

(22) Filed: Aug. 23, 2017

(65) Prior Publication Data

US 2019/0060855 A1 Feb. 28, 2019

(51) Int. Cl.
*B01F 15/00* (2006.01)
*B01F 7/22* (2006.01)

(52) U.S. Cl.
CPC ..... *B01F 15/00389* (2013.01); *B01F 7/22* (2013.01); *B01F 15/00006* (2013.01); *B01F 15/0072* (2013.01); *B01F 15/00155* (2013.01); *B01F 2015/00629* (2013.01); *B01F 2215/0036* (2013.01); *B01F 2215/0049* (2013.01)

(58) Field of Classification Search
CPC ..... B01F 15/00155; B01F 15/00389; B01F 7/22; B01F 2015/00629; B01F 2215/0036; B01F 2215/0049
USPC ..... 366/279
See application file for complete search history.

(56) References Cited

U.S. PATENT DOCUMENTS

2007/0085496 A1* 4/2007 Philipp ..... A61B 17/151 318/139
2007/0125508 A1* 6/2007 McVane ..... B01F 3/1221 164/15
2017/0151541 A1* 6/2017 Young, II ..... B01F 7/16
2017/0216801 A1* 8/2017 Boettcher ..... B01F 3/1221

FOREIGN PATENT DOCUMENTS

CN 205412781 U 8/2016

* cited by examiner

*Primary Examiner* — Marc C Howell
(74) *Attorney, Agent, or Firm* — Thomas Omholt; Erika S. Wilson

(57) ABSTRACT

Described are systems and methods of mixing a liquid in a container, while liquid is being added or removed from the container, and with control of the speed of a mixing device that mixes the liquid to prevent an undesired mixing effect such as splashing, formation of a vortex, foaming, and vibration of a shaft of a mixing device used to mix the liquid.

5 Claims, 3 Drawing Sheets

SYSTEMS FOR MIXING A LIQUID AND RELATED METHODS

FIELD OF THE INVENTION

The invention relates to mixing systems, including components thereof, and methods of using a mixing system to mix a liquid in a container in a manner that prevents or reduces the occurrence of undesired mixing effects such as splashing, foaming, formation of a vortex, or resonance (vibration) of a shaft of a mixing device.

BACKGROUND

Among the range of various different types of technologies that exist in modern industry, one that is pervasive throughout a variety of technological disciplines, and that is important in the manufacture or use of a vast number of commercial and consumer products, is the technology of mixing liquids. Most industries have some level of need for combining and mixing liquid materials, for example to provide homogeneity in a liquid raw material, ingredient, or product. Mixing processes are essential to the food industry, the pharmaceutical industry, to chemical and chemical processing industries, to semiconductor processing and fabrication industries, for preparing and using agricultural chemicals, and in the manufacture of products ranging from chemical materials (e.g., paints, coatings, adhesives, etc.), to polymers (e.g., plastics, thermoplastics, thermosetting polymers, curable monomers and polymers, etc.), building materials, and for use in drilling and mining processes, among others. Liquids that require mixing to homogeneity can be in the form of aqueous or organic-solvent-based solutions, suspensions, emulsions, high solids-containing liquid monomeric or polymeric materials, etc., and may contain an aqueous or organic liquid medium as a solvent of dissolved materials, or as a medium to suspend another solid or liquid material. The liquid or constituent of the liquid may be reactive, curable, or biologically active, etc.

Mixing a liquid, however, must in many instances be performed with specific care to provide a desired mixing effect such as homogeneity, without otherwise undesirably affecting the quality of the liquid being mixed. Certain undesired mixing effects are types that can be easily observed in a liquid during mixing, such as when unwanted foam or bubbles are produced, if a high amount of mixing shear causes coagulation of materials of a liquid, or if mixing produces a vortex that pulls air into the liquid. In other instances, an undesired mixing effect may be less noticeable or possibly considered inconsequential, such as when small droplets of liquid, or residue of a foam, contacts a container sidewall during mixing in a manner that causes solid or dissolved materials of the liquid to become located and retained on the sidewall and removed from the bulk volume of the liquid being mixed.

Certain general and specialty types of mixing technologies have been developed for different areas of industry. In the industries for processing microelectronic devices, specifically with respect to chemical-mechanical polishing (CMP) processes, liquid compositions referred to as slurries ("CMP slurries") contain water, suspended abrasives, and dissolved chemicals. Other liquid compositions useful in the semiconductor and microelectronics industries contain dissolved chemicals such as acid, base, surfactant, polymers, and other chemicals. These liquids are used in extremely sensitive and well-controlled processes of polishing, planarizing, or cleaning in-process microelectronic and semiconductor devices. The chemical ingredients are present at very low concentrations, sometimes in a range of a number of parts per million, and the concentration of each chemical ingredient must remain at a set concentration for the ingredient, to achieve consistent performance upon use of the liquid.

During shipment or storage of a CMP slurry that contains suspended particles, the suspended particles can settle at the bottom of a container, or (less obviously) can become stratified due to gravity within the liquid, meaning that liquid at a lower portion of the container contains a higher concentration of suspended particles, and liquid at the upper portion of the container contains a lower concentration of the particles. Compositions that contain only dissolved chemicals may also experience similar stratification. In the instance of stratification or settling of dissolved or suspended materials of a slurry or liquid (e.g., solution) useful in microelectronic processing, e.g., chemical-mechanical processing and related cleaning or treatment steps, the slurry or liquid requires re-homogenized before use in a tool or processing system. During use, in fact, over a period of hours, days, or weeks during which a slurry or liquid is removed from a container for use, a common practice is to mix the liquid on a continual, un-interrupted basis, so that the liquid remains homogenous for use on demand.

Typically, a slurry or other process composition for a CMP process is withdrawn from a container such as a drum or a tote using an inserted dip tube that is connected to a dispense head that is attached to a feed line and a distribution system of a CMP processing tool. The feed dip tube extends to near the bottom of the container, so that a process composition (e.g., slurry, cleaning composition) is withdrawn from that location first. Without re-homogenizing a stratified CMP slurry, the slurry may have a high concentration of its solid abrasive materials at the bottom of the container, and a lower concentration at the top of the container, due to stratification. The result is inconsistent concentrations of the abrasive particles in slurry removed from the same container. Slurry that is removed first, from the bottom of the drum, will have a relatively higher solids concentration as compared to the solids concentrations of slurry removed last. The concentration of the abrasive materials in the slurry will become progressively lower as the slurry is emptied from the container. The variation in solids gives a "saw tooth" result when charted over a series of drums that contain stratified slurry, with increases in concentration occurring at every change from an empty container to a full container.

For CMP applications, at least two types of mechanical mixing (i.e., "agitation") may be useful: constant speed mixers, and variable speed mixers. Constant speed mixers have drawbacks of the mixer potentially causing splashing or a vortex in the liquid as an amount of liquid in a container gradually decreases. As an amount of liquid in a container is gradually reduced, the rate of mixing (if constant) becomes too high for the amount of the remaining liquid and the result can be splashing, vortex formation, or foam formation.

Variable-speed mixing to control a mixer speed as liquid is removed from a container has been proposed as a way to reduce splashing, vortex formation, or foaming. Capacitive sensors have been used to detect the level of liquid in a container, but these types of sensors have significant drawbacks. If foam becomes present at a surface of a liquid inside of the container, the foam may often cause the capacitive sensor to signal an incorrect reading, which can cause an incorrect mixing speed relative to a correct level of liquid in the container. Additionally, capacitive sensors do not per-form adequately with respect to monitoring an entire volume of a container, because, for example, these types of sensors may not allow for detection of amounts of liquid in a container at a bottom portion of the container. Capacitive sensors are also only a pinpoint detection source only allowing detection at set points.

The mixing of liquids in other areas of technology can also suffer undesired mixing effects if mixing is not sufficiently well controlled. Some types of chemical liquids, e.g., certain reactive monomers and polymers, can suffer premature and undesired reaction activity in the presence of air. In these systems, a vortex that causes air to become incorporated into the liquid as the liquid is being mixed can be highly detrimental to the quality or consistency of the liquid. Controlled mixing is desired to prevent a vortex, which may bring air into the liquid.

In various other liquid chemical systems, bubbles in the liquid are undesired, for a range of reasons. In these systems, controlled mixing can also be desired to prevent a vortex that would incorporate bubbles into the liquid.

Variable speed mixers have been an option to try to control mixing speed of mixing systems. However, improved methods of using mixing systems to prevent undesired mixing effects continue to be desired and of commercial value and importance.

The ability to effect uniform mixing, homogenization, or re-homogenization of a liquid composition in a container, in a commercially efficient manner, while liquid is slowly or gradually, optionally intermittently, removed from or added to the container, and without undesired mixing effects, has a high level of value for a wide range of commercial, industrial, and institutional mixing applications.

For countless varieties of different types of liquid materials, use or processing of the liquid requires mixing, homogenizing, re-homogenizing, or continuously circulating the liquid within a container during a period of use or processing of the liquid. Often, during a period of use or processing, liquid will be continuously or intermittently removed from or added to the container. If mixing during a period of use or processing is performed with insufficient care and attention, especially for a system that involves adding liquid to or removing liquid from the container during mixing, the mixing can result in undesired mixing effects. As the amount of liquid in the container is increased or decreased, if mixing speed is not adjusted, a result can be an effect such as one or more of: splashing at the surface of the liquid being mixed, the formation of foam or bubbles in the surface of the liquid, or the formation of a vortex of the liquid in the container during mixing.

A vortex is generally undesired during mixing of many liquids, because a vortex may detrimentally incorporate bubbles of gas present above the liquid (e.g., air), into the liquid. Generally, bubbles of air incorporated into a liquid may be potentially detrimental to the liquid or to a process of subsequently using of the liquid, depending on the type of the liquid and its purpose. Air bubbles in a liquid may be detrimental to the liquid if the liquid is sensitive to air, e.g., the liquid contains a chemical that reacts or degrades in the presence of air or a constituent of air such as oxygen or moisture. Alternately, certain liquids are desirably mixed without allowing air to be entrapped in the liquid in the form of bubbles, to prevent the bubbles from being present in a subsequent use or in a product made from the liquid. As one example, the formation of bubbles during mixing of a curable liquid is preferably avoided, if the cured liquid is one that should not contain bubbles.

Splashing of a liquid during mixing in a manner that causes small or tiny droplets of the liquid to contact a sidewall of a container that holds the liquid, can also be detrimental when mixing certain types of liquids. For some liquids, splashing might be considered an inconsequential occurrence and may not have a significant detrimental effect during mixing of the liquid or during use of the liquid after mixing. But splashing may have a noticeable detrimental effect when mixing a liquid that contains a very precise (especially also, very low) amount of dissolved chemical ingredient. In specific, splashing of a liquid can cause a transfer of a dissolved chemical ingredient from the liquid to the interior sidewall of the container. Upon splashing of liquid droplets onto sidewalls at an interior of a container, the splashed droplets become dried upon the surface, leaving the dissolved chemical ingredient from that drop as dried material on the sidewall. In the end, the dissolved chemical material of the splashed droplet has been removed from the liquid in the container. The concentration of that dissolved chemical ingredient in the remaining liquid of the container, when dispensed from the container, will be reduced relative to a desired concentration, i.e., relative to an original concentration of that dissolved chemical ingredient in the liquid when placed in the container, and when the container was full. In certain processing systems, a very small loss of dissolved chemical ingredient from a liquid raw material, caused by this form of splashing, can be sufficient to produce undesired and detrimental effects in a process that uses the liquid raw material.

Foaming or bubble formation of liquid during mixing can also be detrimental to a liquid. On one respect, for certain types of liquids, foaming (as with splashing) can cause a loss of a dissolved chemical ingredient from the liquid due to the foam contacting sidewalls of the container and drying on the sidewalls to leave the dissolved chemical ingredient at the sidewall, removed from the liquid. The result is a reduced concentration of that chemical ingredient in the liquid when the liquid is eventually dispensed from the container for use, especially for a final remaining portion of the liquid removed from the container after most of the liquid has been previously removed.

Additionally, foam is prone to drying, and foam of certain types of liquids, e.g., a CMP slurry, which contains solid abrasive particles, can cause drying of the abrasive particles within the container. The dried abrasive particles can agglomerate to form agglomerated particles that are capable of causing unwanted processing difficulties in a system that uses the liquid, such as clogging of a filter or a dispense head, or defects in a workpiece being processed by use of the slurry.

SUMMARY

In view of these types of undesired mixing effects, a broad range of general and specific types of liquids and mixing systems will benefit greatly from systems and methods that automatically control mixing of a liquid in a container while an amount of liquid in the container increases or decreases, in a manner to provide efficient (rapid and thorough) mixing while avoiding undesired mixing effects such as: a vortex, splashing, foaming, or vibration of a shaft of a mixing device.

Accordingly, at least three general categories of liquid materials can be specifically considered as potentially benefiting from systems and methods of controlled mixing as described: liquids that contain a low and a very precise amount of one or more dissolved chemical ingredients and that are supplied to and used by a processing system that requires the liquid to be highly uniform in the concentration over a course of removing the liquid from a container, meaning that the concentration of the dissolved chemical ingredient does not vary between a top portion of a container and a bottom portion of the container, i.e., intra-container variation is minimized; liquids that contain chemical reactants that can be caused to react in the presence of air or a component of air such as moisture, oxygen, etc., wherein the air or the component of air may function as a catalyst or a reactant of the reaction; and curable materials (including but not limited to curable polymeric materials) that require mixing to homogeneity, followed by curing, and that should be mixed in a manner that does not cause bubbles (e.g., air bubbles) to be formed in the liquid during mixing, so that bubbles are not ultimately present in the curable material upon curing.

In one aspect, the invention relates to a system for circulating liquid in a container. The system includes: a container that includes an interior volume having a depth, and a mixer adapted to circulate liquid contained in the interior volume. The mixer includes: an impeller adapted to contact liquid contained in the interior volume, and a variable speed controller capable of adjusting a frequency of the impeller. The system can also include a conduit in fluid communication with the interior volume and capable of allowing liquid to be added to or removed from the interior volume of the container. The system includes a detection system capable of detecting a location of an upper surface of liquid contained in the interior volume. The detection system is adapted to provide a control signal based on the location of the upper surface, and the control signal can be used to cause the variable speed controller to adjust the frequency of the impeller based on the location of the upper surface.

In another aspect, the invention relates to a method of mixing fluid in a container. The method includes providing a system that includes: a container that includes an interior volume having a depth; a volume of liquid contained in the interior volume; a mixer adapted to mix the liquid within the interior volume; wherein the mixer includes: an impeller in contact with the liquid, and a variable speed controller capable of adjusting a frequency of the impeller. The system additionally can include a conduit in fluid communication with the volume of liquid and capable of allowing liquid to be added to or removed from the interior volume of the container. The system additionally includes a detection system capable of detecting a location of an upper surface of the liquid. The detection system provides a control signal based on the location of the upper surface, and the control signal can be used to cause the variable speed controller to adjust a frequency of the impeller based on the location of the upper surface.

DETAILED DESCRIPTION

Figure 1:
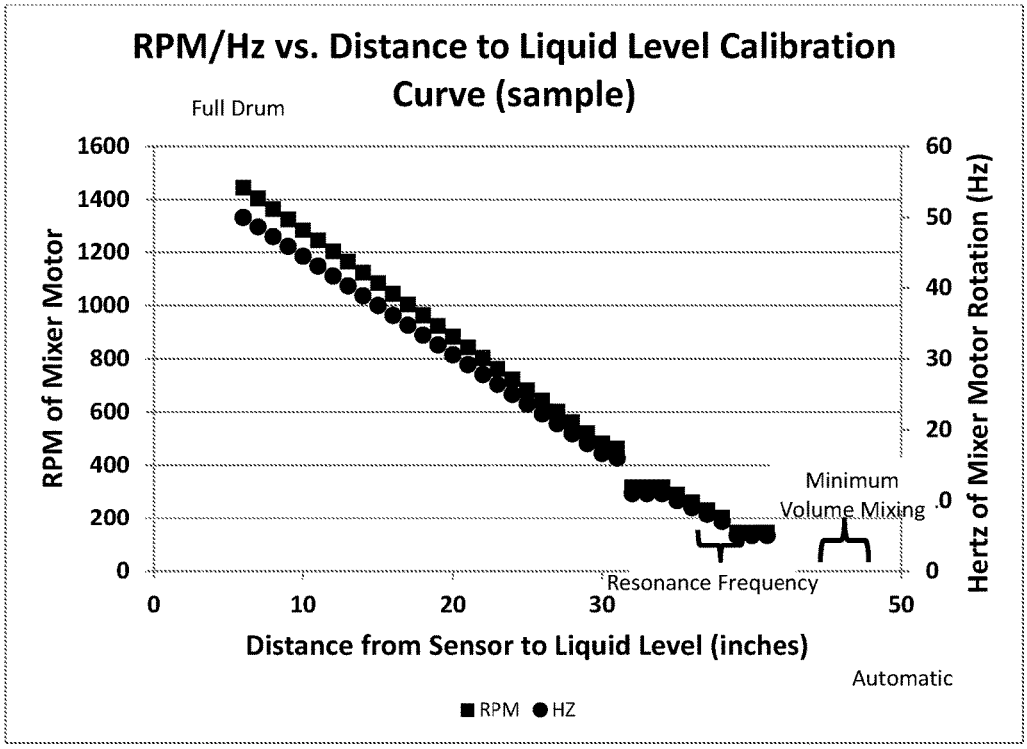
FIG. 1 is a graph that shows relates speed (rpm) of a mixer to a level of liquid in a container FIGS. 2A (side view) and 2B (top view) illustrate embodiments of mixing systems of the present description.

The present invention relates to systems and methods useful for circulating a liquid in a container. The system (i.e., "mixing system" or simply "system") includes, among other items, a variable speed mixer adapted to circulate liquid contained in the container. The system can be adapted to work with a container, which typically includes an upper opening at a top of the container, container sidewalls extending from the upper opening to a container bottom, and which contains a liquid when used with the mixing system. An optional cover ("top") may be placed over the upper opening during use and if present must be not metallic, e.g., can be plastic. A conduit can be present at the interior of the container, leading from the interior to an exterior of the container, to allow liquid to be removed from the interior and carried to the exterior, or added to the interior from an exterior location.

The variable speed mixer includes a variable speed motor and a mixing device attached to the motor. A mixing device may be any device or structure that can be controlled by the variable speed motor to cause movement, i.e., circulation, of fluid in the container, such as by movement (e.g., rotation) of the mixing device while at least a portion of the mixing device contacts liquid in the container. An example of a mixing device can be a device that includes an elongate shaft that extends from the motor and that includes a first end engaged with the motor and a second end that is a mixing end. The mixing end may include, for example, an impeller or another surface that when submersed in liquid and then rotated will cause movement of the liquid within the container. The elongate shaft allows the variable speed mixer to operate with a mixing end of the shaft at a desired location within the container, e.g., in contact with liquid contained in the container, while the variable speed motor can be located exterior to the container. The shaft may extend from a location of the motor, which is at the exterior of the container, to an interior location at which location the mixing end can engage liquid that is contained within the container, and can be rotated to cause movement of the liquid.

The mixing system includes a detection system to sense the amount of liquid in the container, for example by sensing a level of the surface of the liquid in the container relative to a reference location such as a location of the top or upper opening, or approximately the top or upper opening, of the container. According to the invention, the mixing system and method for using the mixing system can be generally and advantageously used to circulate a liquid in a container in a manner that avoids the occurrence of one or more undesired mixing effects, such as one or more of: the formation of a vortex in the liquid being circulated within the container; splashing of the liquid within the container, especially to cause liquid to contact an interior sidewall of the container; foaming, especially to a degree that causes the foam to contact interior sidewalls of the container; and vibration of a shaft of a mixing device of a variable speed mixer due to rotation of the shaft at a resonance frequency. In specific, a speed (e.g., frequency) of the variable speed mixer can be adjusted automatically in response to a change in the amount of liquid contained in the container, as determined by the detection system, to avoid undesired mixing effects such as the formation of a vortex. Preferably, the variable speed mixer can be adjusted in a manner that also prevents the variable speed mixer from being set at a frequency that is a resonance frequency of a shaft of a mixing device, which can be mechanically detrimental to the mixing device.

The detection system is adapted to and is capable of sensing a surface of a liquid within the container, while optionally and preferably being located completely or essentially completely outside of the container. The detection system contains a radar transmitter ("emitter") and a radar receiver (which can, but does not have to be, housed in a single unit), each of which can operate as part of the mixing system while each is located at a position that is on the exterior of the container. The radar transmitter and radar receiver (as well as the mixer) are also, preferably, moveable, i.e., portable, allowing the radar transmitter and radar receiver to be easily and efficiently moved from use on a first container to use on a second container.

An example of a preferred radar transmitter can be of a type that is adapted to transmit a radar signal from an exterior location above a top or upper opening of a container as described, through the top of the container (which is permeable to the radar signal, e.g., is plastic), and down toward the liquid held at the interior of the container. The signal is at least partially reflected off of the substantially horizontal surface of the liquid within the container. During use of the mixing system, the liquid in the container is being circulated by the mixing device, but is mixed in a manner so that the liquid is preferably maintained to be free of a vortex and to have a surface that is smooth and does not have any substantial amount of foam or bubbles present at the surface. The reflected signal is directed back up in a direction toward the container top (or upper opening) and is able to penetrate the container top (if present) to be received by the radar receiver placed at a location that is exterior to the container. The detection system, using this information derived from the transmitted and received signals, generates a control signal that can be used by the detection system or by a separate device such as a programmable controller, to adjust a speed of the variable speed mixer.

The mixing system optionally and preferably also includes a variable speed controller, which may preferably be a programmable controller, that contains electronics such as a computer (e.g., laptop computer, or tablet, etc.), a programmable logic controller (PLC), or another programmable electronic device (containing, for example one or more of computer hardware, software, memory (ROM, RAM, or both), a microprocessor, a central processing unit ("CPU"), or the like) that can be programmed to control or monitor information relating to the transmitted radar signal and the reflected signal, and to use that information to calculate a level of the surface of the liquid inside of the container, such as by calculating a distance between the liquid surface and the transmitter, receiver, or both. The programmable controller also, preferably, contains electronic information relating to a calibration curve of a mixing system, which allows the programmable controller to set a frequency of a mixer at a desired level below a frequency that would produce a vortex, and to automatically change the frequency of the mixer (as fluid is added to or removed from the container) to a frequency that provides efficient mixing but that remains below a frequency that would produce a vortex. The programmable controller can also, preferably, contain electronic information relating to a resonance frequency of a mixing device, to allow the variable speed mixer to avoid operating at the resonance frequency.

The detection system and optional programmable controller can be used to measure a level of the liquid inside of the container, as well as changes in the level of the liquid, preferably without any portion of the detection system or programmable controller being located within the container. The detection system can be programmed to continuously or semi-continuously, e.g., periodically, sense a level of the liquid in the container (i.e., the location of the surface of the liquid), thereby allowing detection of a change in the level of the liquid in the container. In response to a changing level of liquid, which may be either increasing or decreasing, the detection system or the optional programmable controller adjusts the speed of the variable speed mixer, to increase the speed or decrease the speed of the variable speed mixer in a manner that maintains efficient mixing of the liquid while avoiding the formation of a vortex in the liquid, or another undesired mixing effect, and while also avoiding a resonance frequency of a shaft of a mixing device. When the level of liquid in the container increases, the speed of the variable speed mixer is increased. When the level of the liquid is reduced, the speed of the variable speed mixer is reduced.

Generally, the detection system can be used to allow the mixing system to mix a liquid contained in the container, continuously or semi-continuously over a desired period of time, i.e., a mixing period, which may be minutes, hours, days, weeks, or more, while liquid is either added to or removed from the container, and in a manner that allows for efficient mixing of the liquid while preventing any undesired mixing effect. In particular, by the system controlling a frequency of the variable speed mixer to a frequency that is below (but near) a minimum frequency at which a vortex forms, the system can prevent the liquid from forming a vortex in the container during mixing. Normally, by avoiding the formation of a vortex, foam and splashing are also avoided.

As used herein, the term "vortex" refers to a condition during mixing of a liquid in a container that results in a rotating mass of liquid in a container, wherein the rotating mass of liquid produces a force of suction that is sufficient to draw (e.g., entrain) gaseous atmosphere that is present above the liquid, into the liquid in the form of bubbles within the liquid. The gaseous atmosphere may be air or may be a non-air gas such as an inert gas, if present above a liquid that is being mixed.

According to the present description, methods and systems can be configured to mix liquid in a container, with liquid being added to or removed from the container, and while controlling (e.g., automatically) the frequency of the mixer and mixing device to avoid the formation of a vortex, while still maintaining efficient mixing. While avoiding a vortex is a goal of a mixing system and method as described, most commercial mixing operations also need efficient mixing, meaning mixing at a sufficiently high speed (frequency) to allow for efficient processing or use of a liquid being mixed. Avoiding vortices and incorporation of air into the liquid being mixed may generally be accomplished by maintaining a very low mixing speed. But low speed mixing reduces efficiency and throughput of commercial production processes. According to the present invention, a desirably high mixing speed can be achieved, without causing undesired mixing effects such as splashing, a vortex, or incorporation of air (e.g., as bubbles), by continuously controlling a mixing speed at a frequency that is below (but near) a "vortex-inducing frequency," while adding or removing liquid from the container. A desired frequency that is below the vortex-inducing frequency but still sufficiently high to produce efficient (e.g., rapid and thorough) mixing can be a mixing frequency that is close to but below a vortex-inducing frequency (for a given level of liquid in a container), such as a frequency that is from 80 to 99 percent of the vortex-inducing frequency, or from 85 to 99, e.g., 90 to 95 or 98 percent of the vortex-inducing frequency (for a given level of fluid in a container).

Also according to certain preferred embodiments of systems and methods of the described invention, the system can be adapted to mix a liquid, in a container, using a variable speed mixer with a mixing device that includes a shaft, over a range of frequencies that avoids (i.e., skips or bypasses) any frequency that causes vibration of the shaft. A rotating shaft such as a shaft that may be useful as part of a mixing device as described herein can have one or more characteristic rotational frequencies at which the shaft will naturally vibrate, e.g., resonate. Any such frequency can be referred to herein as a "resonance frequency." When decreasing or increasing a speed of a variable speed mixer as described, to adjust for changes in an amount of liquid that is present and being mixed in the container, absent any precaution to the contrary, a rotational speed (frequency) of a shaft of a mixing device may potentially be set to a resonance frequency of the shaft. Rotation of the shaft at a resonance frequency is desirably avoided, and, according to embodiments of systems and methods of the present description, a programmable controller can be programmed to avoid setting a variable speed mixer to rotate a shaft at resonance frequencies during a mixing process as a frequency of a mixing device is increased or decreased.

In specific, for a system that includes a mixing device and a shaft, a resonance frequency of the shaft can be identified and provided electronically as part of the mixing system, e.g., as information stored and useable by a programmable controller. During use, as a level of liquid in a container approaches a level at which a mixing speed will be at or near a resonance frequency, the programmable controller will identify the potential that the mixing device will be set at a speed that matches the resonance frequency of the shaft. As the frequency of the mixing device approaches the resonance frequency, the programmable controller will (instead of setting the mixing speed at the resonance frequency) adjust the speed of the mixing device to a different useful speed (frequency) that is slightly below or optionally slightly above (e.g., 2, 5, or 10 percent below or above) the resonance frequency.

As an example, with an increasing impeller speed (due to liquid being added into a container) that approaches a resonance frequency, a programmable controller can be programmed to maintain a steady impeller speed that is below the resonance frequency, while liquid continues to be added to the container. When the programmable controller detects that the liquid level has increased past a level at which the mixing device would be set at the resonance frequency, the programmable controller increases the frequency to an otherwise programmed frequency that is below but near a vortex-inducing frequency.

As another example, with a decreasing impeller speed (due to liquid being removed from a container) that is approaching a resonance frequency, a programmable controller can be programmed to decrease the impeller speed past the resonance frequency, to a frequency that is below the resonance frequency. As liquid continues to be removed from the container, the frequency can be programmed to remain steady at a frequency below the resonance frequency. When the level of liquid in the container has decreased to a level that is below a level at which the mixing device would be set at the resonance frequency, the programmable controller returns to controlling the frequency at an otherwise programmed frequency that is maintained below but near a vortex-inducing frequency, and additional liquid is again removed from the container with additional reduction in the mixing frequency.

Preferably, to efficiently mix a liquid in a container while avoiding undesired mixing effects, a mixing system as described, including a detection system, can be calibrated, with calibration information being programmed into a programmable controller, to allow the programmable controller to automatically cause continuous and efficient mixing of a liquid in a container while avoiding undesired mixing effects. The programmable controller can automatically cause a change in the frequency of the variable speed mixer when a level of liquid in the container increases or decreases, to maintain the frequency of the mixer at a frequency that is near to but below a vortex-inducing frequency. The programmable controller can contain information and programming that include data of a calibration curve, which is a plot of a vortex-inducing frequency of a mixing motor versus an amount of liquid in a given container. A frequency that is a vortex-inducing frequency of a liquid in a container, and, therefore a set of vortex-inducing frequencies over a range of amounts of liquid in a given container, can depend and may differ factors of a mixing system that include: the type of container (e.g., shape, such as a tote drum), the size of the container, the type of the liquid including physical properties of the liquid such as density and viscosity, among others, with viscosity of the liquid (for a given size and type of container) being a highly influential factor. A calibration "curve" is typically a linear function or substantially linear function that relates mixing speed (frequency, e.g., revolutions per minute (RPM)) to a level of liquid in the container. A calibration curve with this information can be determined for a certain system (e.g., specific container, and specific liquid, or liquid with a specific viscosity) by identifying two or more vortex-inducing frequencies (at two different liquid levels) of a liquid of a given type or viscosity, in a given container (size, shape, etc.). Because the relationship is substantially linear, a line can be drawn from the two data points to complete the calibration information (i.e., calibration curve).

Referring to FIG. 1, a calibration curve for a container (drum) of liquid is shown, which relates mixer frequency (RPM) to a level of liquid in the drum. The graph plots a set of points (in a line) of vortex-inducing frequencies. Below this line, but near the line, i.e., at a speed that is near but below the vortex-inducing frequency for a given level of liquid, a useful range of mixing speeds exists that will provide efficient mixing without producing a vortex. A preferred range for mixing speed, at a given liquid level, can be in a range from 80 to 99, e.g., from 85 to 95 or 98 percent of the vortex-inducing frequency.

Still referring to FIG. 1, a small range of mixing speed versus a liquid level, from about 32 to about 35 inches, in FIG. 1, represents a liquid level at which a vortex-inducing frequency, or just below, would be a resonance frequency of a mixing device, e.g., the range of RPMs between about 300 and 425 RPM. To avoid the resonance frequency when reducing the mixing speed in response to a decreasing level of liquid in the container, a programmable controller can detect the approach of the resonance frequency and can reduce the mixing speed from above the resonance frequency (e.g., about 420 RPM) to a mixing speed that is below the resonance frequency (e.g., about 300 RPM), essentially instantaneously, without causing the variable speed mixer to be set for any substantial amount of time on the resonance frequency.

Stated differently, the graph of FIG. 1 includes a resonance frequency of about 375 RPM. The programmable controller can be set to bypass this frequency when decreasing mixing speed (frequency) in response to a decreasing liquid level. As an example, a resonance frequency range may be defined as a range of frequencies that includes the resonance frequency, and a range of frequencies above and below the resonance frequency, e.g., frequencies from 300 to 425 RPM. The programmable controller, during this resonance frequency range, can be programmed to maintain a constant mixing speed that equals the speed at the lowest frequency, i.e., 300 RPM. When the level of liquid eventually reaches a level at which that the programmable controller would set the mixer to this lowest frequency, normal control resumes, whereby the programmable controller again automatically sets the speed of the variable speed mixer to a speed that is just below a vortex-inducing speed for a level of liquid, as the level continues to decrease.

Figure 2A:
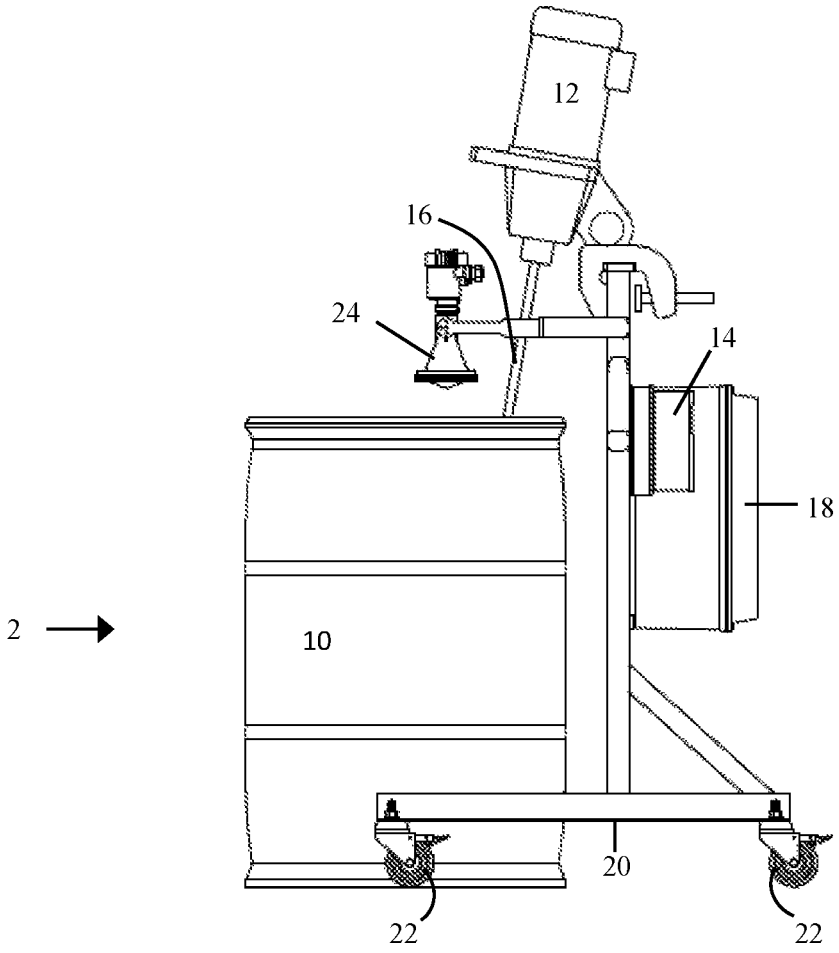
Figure 2B:
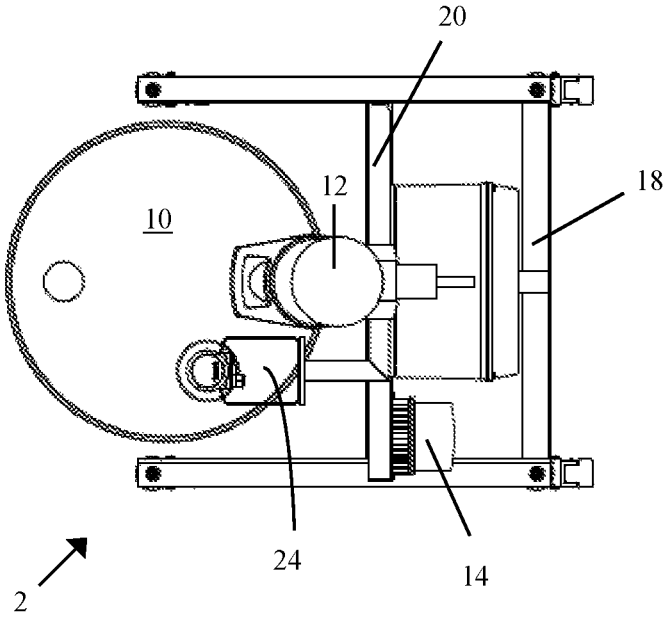

Referring to FIGS. 2A and 2B (side and top views, respectively), illustrated is an example of a mixing system as described, that includes container (drum) 10; variable speed motor 12; variable speed (e.g., programmable) controller 14; mixing device 16, which includes a shaft (shown) and impeller at a mixing end of the shaft (not shown); motor power supply 18; mixing stand 20; locking casters 22; and radar emitter and receiver 24. Not shown, but part of a mixing system during use, is a conduit extending into container 10 to allow liquid from inside container 10 to be removed or added. As illustrated, radar emitter and receiver 24 is located above a top (or upper opening) of container 10 and is completely outside of the container 10; no part of the mixing system other than a portion of mixing device 16 that contacts the liquid, e.g., shaft and impeller, is located inside of container 10 or in contact with liquid contained by container 10.

Radar receiver and emitter 24 can be any radar emitting and receiving unit that can: transmit a radar signal through a container top (e.g., plastic top), whereby the signal can reflect off of an upper surface of liquid in the container; receive the reflected signal; and then either provide information relating to the signals that is useful to calculate a distance between the transmitter, receiver, or both, and the level of the liquid inside of the container, or calculate that distance. In other embodiments, the container does not include a top (plastic or otherwise) and the radar emitting and receiving unit may be located above the upper opening of the container. The radar receiver and emitter 24, by being operated continuously or at short intervals, can detect changes in the level of the liquid inside of the container, meaning small increases or decreases in the level. Examples of such devices are commercially available. Useful examples include radar receiver and emitter devices that (as shown at FIGS. 2A and 2B) are capable of being removed from use with a first container and easily placed in a position for use with a second container.

A container for use in a system of the present description can be any useful container such as a drum, barrel, or tote, with examples including large (e.g., 55 gallon) drums and totes sometimes used in the chemical-mechanical-processing industries to contain an abrasive slurry or cleaning composition, or in the chemical and polymer industries to contain chemical and polymer materials in liquid form. The container may be of any size, shape, and material, with a top of the container being of a type that allows penetration of a radar signal, e.g., the top may be a plastic material. Preferably, the container does not require and does not contain any baffles that would inhibit movement or circulation of liquid being mixed inside of the container.

The presently-described systems and methods can be useful for mixing any type of liquid, which may be a solution, slurry, emulsion, suspension, or any other form of liquid. One example of a type of liquid that can be mixed, with particular benefit by use of the present systems and methods, are liquids that may settle or stratify during storage or use, and that are added to or removed from a container gradually, with mixing, during use. For example, some commercial liquids may experience settling or stratification over a period during which the liquid is removed for use from the container. For these liquids, it is common practice to agitate the liquid continuously over a period of time during which the liquid is being removed from the container, which may be a period of hours, days, or weeks or more. The continuous agitation prevents settling or stratification of suspended or dissolved ingredients of the liquid. But, continuous mixing in the absence of speed control can result in undesired mixing effects.

Various examples of general types of liquids can be considered as potentially benefiting from systems and methods as described, by which a mixing frequency of a variable speed mixer is controlled and adjusted based on a level of liquid contained by and being mixed in a container. A first example is: liquids that contain a low and a very precise amount of one or more dissolved chemical ingredients, and that are supplied to and used by a processing system that requires the liquid to be highly uniform in concentration of the dissolved ingredients over a course of removing the total amount of liquid from a container, meaning that the concentration of a dissolved chemical ingredient should not be reduced substantially (e.g., by more than 20, 10, or 5 percent) between an early portion of liquid removed from the container and a later portion of the liquid removed from the container, over the course of removing the complete amount of liquid from the container, i.e., intra-container variation of a concentration of dissolved chemical ingredient is minimized. A second example is any liquid that contains dispersed particles, such as abrasive particles, that may become agglomerated during mixing if foam is formed from the liquid. A third example is any liquid that contains chemical reactants that can be caused to react in the presence of air or a component of air such as moisture, oxygen, etc., for example wherein the air or the component of air may function as a catalyst or a reactant of the reaction. Yet another example is any curable liquid material (including but not limited to curable polymeric materials that are cured by chemical reaction, or that are cured by reduced temperature) that requires mixing to homogeneity followed by curing (e.g., by chemical reaction or by solidification (e.g., by reducing temperature)), and that should be mixed in a manner that does not cause bubbles (e.g., air bubbles) to be formed in the liquid during mixing, so that bubbles are not ultimately present in the curable material upon curing.

Among liquid chemical materials that fall within one or more of these categories are chemical materials used in processing semiconductor and microelectronic devices, including chemical-mechanical-processing (CMP) slurries, cleaning compositions, and other such process compositions. The process compositions generally contain low concentrations of dissolved chemical ingredients (e.g., catalyst, surfactant, inhibitor, stabilizer, etc., in an amount of between about 0.1 and 10 weight percent during use), optionally in combination with an amount of dispersed abrasive particles (e.g., in an amount of between 1 and 10 weight percent during use). Some of these liquid process compositions may experience settling or stratification of ingredients within a matter of hours, e.g., in as short as 3 or 6 hours, to a degree that will affect the consistency or quality of a CMP process that uses the liquid process composition. (Examples of abrasive particles that may exhibit relatively rapid settling or stratification include alumina particles, ceria particles, and silica (fumed or precipitated) particles.) These process compositions produce most consistent results during processing when the concentrations of solid and dissolved chemical ingredients remain constant and at an original concentration of each ingredient during the course of gradually removing the process composition from a container for use over a period of hours, days, or weeks, during which period the process composition is continuously circulated (mixed) within the container to prevent stratification of the solid and dissolved materials.

More specifically, certain state-of-the-art CMP compositions can be surprisingly susceptible to intra-container concentration variations of a dissolved chemical material due to splashing and foaming during mixing within a container as the composition is removed over a period of hours, days, or weeks. Splashing or foaming during mixing as the composition is gradually removed from the container causes dissolved chemical ingredients to be removed from the liquid process composition and retained at sidewalls of the container, resulting in a noticeably lower concentration of the dissolved ingredient being present in the portion of the liquid that is removed when the container is near empty (e.g., ⅓ or ¼ full), relative to the concentration of the dissolved ingredient in portion of the liquid that is removed first from the same container, when the container is full.

In certain examples of methods as described, a concentration of a dissolved chemical ingredient in a liquid (e.g., a CMP slurry), present in the liquid at a relatively low concentration (e.g., below 1,000, 500, or 100 ppm), in a later portion of the liquid (i.e., a portion that is removed from a container when the container is nearly empty), can be reduced by not more than 20 percent, e.g., by not more than 10 or 5 percent, relative to the concentration of the dissolved chemical ingredient contained in an early portion of the liquid removed (i.e., a portion of the liquid that is removed from the container when the container is fully or nearly full). For example, a concentration of a dissolved chemical ingredient in a later portion, removed when the container is less than 20 or 25 percent full, can be at least 80, 90, or 95 percent of the concentration of the dissolved chemical ingredient present in an early portion removed from the container, removed from the container when the container is at least 80 or 90 percent full.

Typical CMP process compositions used today contain a relatively low amount of abrasive particles (at use, e.g., below 10 weight percent, e.g., from 0.1, 0.5 or 1, to 10 weight percent, such as below about 5, 4, 3, 2, or 1 weight percent at a point of use), and low but very precisely designed amounts of various dissolved chemical ingredients. For example, CMP process compositions may have concentrations of dissolved chemical ingredients that are in the parts per million range, e.g., below 5,000, 1,000, 500, 100, or 20 ppm for a given ingredient, such as for a surfactant, polymer, oxidizer, catalyst, inhibitor, or stabilizer. With these very low concentrations of dissolved chemical ingredients, even a very tiny amount of a dissolved chemical material being lost from the process composition due to foaming or splashing, over the course of delivering a total amount of process composition from a container, can cause a noticeable change in the concentration of that chemical material in a process composition that is delivered to a CMP processing system.

Moreover, preventing foam or splashing during mixing of a CMP slurry can also prevent the creation of undesired agglomerates, which may form upon drying of the foam. Agglomerates, once created in a container of the liquid process composition that is being mixed, can cause difficulties in supplying the liquid process composition to a CMP processing tool, such as by filling up a filter that is in a supply line from the liquid to the tool. Agglomerates can also result in a higher occurrence of defects in a semiconductor substrate that is processed by a CMP processing tool using the process composition, in the event that the agglomerate is passed through a filter to the tool for CMP processing of a substrate.

To achieve reduced point of use costs, very low concentrations of dissolved chemical ingredients in a CMP composition are preferred. Achieving desired performance during use of the process composition requires that the composition be delivered to processing equipment with a consistent and expected concentration of ingredients. Delivering a CMP composition with a consistent concentration of ingredients over a course of removing the composition from a single container is improved by use of methods and systems of the present description for mixing a CMP process composition in a manner that prevents undesired mixing effects such as foaming, splashing or formation of a vortex.

In addition to CMP process compositions, certain other liquid materials are also of a type that can benefit substantially from a mixing method or system as described, which prevents or reduces undesired mixing effects during mixing, over time, while liquid is added to or removed from a container. Liquid reactive chemicals such as reactive monomers or polymers are another example of such liquids. In particular, any liquid that contains a material that can react in the presence of air or a constituent of air (moisture ($H_2O$), oxygen, nitrogen, carbon dioxide), can experience unwanted reaction of the reactive material in the liquid, during mixing, if air becomes incorporated into the liquid either by being absorbed in the liquid or by being entrained in the form of bubbles, such as due to a vortex formed in the container during mixing. Methods and systems as described can allow for mixing of the liquid in a container, while liquid is added to or removed from the container, and with the mixing being accomplished without an undesired mixing effect such as splashing, foaming, or formation of a vortex. Notably, by preventing a vortex from forming in the liquid during mixing, while liquid is being added to or removed from the container, the described methods and systems can prevent air from being incorporated into the liquid, especially in the form of air bubbles. Consequently, methods of the present description that are able to prevent a vortex in a liquid during mixing, thereby preventing incorporation of air into the liquid during mixing, are highly useful for mixing any chemical material such as a chemical monomer, polymer, or mixture thereof, that is susceptible to being reacted, undesirably, in the presence of air or a constituent of air.

A different example of an advantageous use for a mixing system or method as described herein relates to mixing a liquid material that is curable, such as a curable monomeric or polymeric material that includes a thermoplastic or thermosetting monomer or polymer. Materials that are curable require mixing to homogeneity before being cured, but oftentimes are desirably cured to form a uniform, homogeneous solid material that does not contain bubbles, even very small or microscopic bubbles. By use of a system or method of the present description, a curable liquid material can be mixed to a homogeneous liquid composition in a container, with liquid being added to or removed from the container during mixing, in a manner to prevent a vortex from being formed during mixing, to thereby prevent the formation of bubbles in the curable material during mixing. In preferred methods, the homogeneously mixed curable liquid can be cured (e.g., by chemical reaction, i.e., thermoset, or by a reduction in temperature, i.e., as a thermoplastic) after mixing to homogeneity to produce a cured, solid, polymeric material that does not contain any bubbles when examined by an unaided eye, more preferably the material does not contain any bubbles when examined with the aid of 2×, 5×, 10×, 20×, or 50× magnification.

Example thermoplastic or thermoset polymer materials that may be processed by a mixing system or method of the present description include polymer resins selected from the group consisting of thermoplastic elastomers, thermoset polymers, polyurethanes (e.g., thermoplastic polyurethanes), polyolefins (e.g., thermoplastic polyolefins), polycarbonates, polyvinylalcohols, nylons, elastomeric rubbers, elastomeric polyethylenes, polytetrafluoroethylenes, polyethyleneterephthalates, polyimides, polyaramides, polyarylenes, polyacrylates, polystyrenes, polymethylmethacrylates, copolymers thereof, and mixtures thereof.

EXAMPLES

This example describes a mixing system of the present description, optionally as illustrated and described with reference to FIGS. 2A and 2B.

A mixing stand was constructed to secure features of a mixing system relative to a container. A Vegaplus 67 radar gauge was mounted to the mixing stand and attached to a variable frequency drive (VFD) with attached mixing device. A PLC was in communication with the radar gauge and the variable frequency drive, and was programmed to control the entire system, and to specifically avoid operating the VFD at a speed that is a vibrational frequency of the mixing system (shaft) as the speed of the VFD is increased or decreased. The distance from the sensor of the radar gauge to the liquid level was calibrated with two or more mixing speeds to give adequate mixing without vortex formation. The radar gauge sensed the liquid level, and the motor, with attached mixing blade, had its rotations speed controlled by the VFD. The rotational speed was continuously controlled by the VFD as the radar sensed the liquid level. As the volume of liquid in the container was reduced, by the liquid being removed, the radar gauge sensed the changing liquid level and the VFD changes the rotation speed of the mixing motor automatically, to reduce the speed and avoid formation of a vortex, splashing, or foaming. When a mixing speed approached a vibrational frequency of the shaft, the PLC was programmed to step the speed to a speed that is above or below the vibrational frequency to avoid operating at the vibrational frequency.

The system allows any user of a mixing device to adequately (i.e., efficiently) mix a liquid, e.g., a CMP slurry, without causing foaming or a vortex of the liquid in a container, as the container is being emptied gradually over a period of hours, days, or weeks. The system controls the rate of speed of the mixing device automatically to eliminate splashing of the liquid inside the container, which could increase defects in a microelectronic or semiconductor product prepared by a CMP step that uses the CMP slurry removed from the container. As node size decreases in the microelectronics industry, microelectronic device manufacturers are in constant search for ways to improve their total process, including by reducing variability in liquid process compositions. In the context of CMP processing, the present invention can be useful to remove variability in a supply of CMP slurry to a CMP processing device.

The invention claimed is:

1. A system for circulating liquid in a container, the system comprising:

- a container that includes an interior volume having a depth,
- a mixer adapted to circulate liquid contained in the interior volume, the mixer comprising:
  - an impeller adapted to contact liquid contained in the interior volume, and
  - a variable speed controller capable of adjusting a frequency of the impeller,
- a conduit in fluid communication with the interior volume and capable of allowing liquid to be added to or removed from the interior volume of the container, and
- a detection system capable of detecting a location of an upper surface of liquid contained in the interior volume, wherein the detection system is adapted to provide a control signal based on the location of the upper surface, and the control signal can be used to cause the variable speed controller to adjust the frequency of the impeller based on the location of the upper surface, wherein the container includes a bottom, an upper opening, and sidewalls between the bottom and the upper opening, the interior volume being defined by the bottom, the upper opening, and the sidewalls, and wherein the detection system includes a radar transmitter and a radar receiver placed above the upper opening, wherein the transmitter is capable of transmitting a radar signal through the upper opening (and optional plastic top covering the upper opening), the radar signal is capable of reflecting off of a surface of liquid contained in the interior volume, and the receiver is capable of detecting the reflected signal to determine the distance between the receiver and the liquid surface, and wherein the variable speed controller is a programmable controller that is programmed to adjust the frequency as liquid is added to or removed from the interior volume, to cause mixing of the liquid without producing a vortex at the surface of the liquid.

2. The system of claim 1 wherein the programmable controller is programmed to hold the frequency at a frequency that is at least 90 percent of a vortex-inducing frequency as liquid is removed from or added to the interior volume.

3. The system of claim 1 wherein the container contains liquid that is an aqueous slurry that contains abrasive particles and dissolved chemical ingredient.

4. The system of claim 1 wherein the container contains reactive liquid that includes reactive monomer or reactive polymer that can be caused to react in the presence of air or a component of air.

5. The system of claim 1 wherein the container contains liquid that includes curable polymer.

* * * * *